US005201646A

United States Patent [19]

Dees et al.

[11] Patent Number: 5,201,646

[45] Date of Patent: Apr. 13, 1993

[54] SCROLL COMPRESSOR ECCENTRIC BUSHING RETAINER

[75] Inventors: Michael L. Dees, Kettering, Ohio; Mark J. Bookbinder, Bertrange, Luxembourg; Ronald E. Marker, New Lebanon; Michael E. Greene, Kettering, both of Ohio; Dwayne L. Johnson, LaCrescent, Minn.; Edward R. La Marca, Lockport, N.Y.

[73] Assignee: General Motors Corporation, Detroit, Mich.

[21] Appl. No.: 870,980

[22] Filed: Apr. 20, 1992

[51] Int. Cl.[5] ..... F04C 18/04; F04C 29/02

[52] U.S. Cl. ..... 418/55.5; 418/55.6; 418/57; 418/100

[58] Field of Search ..... 418/55.5, 55.6, 57, 418/100

[56] References Cited

U.S. PATENT DOCUMENTS

| | | | |
|---|---|---|---|
| 4,435,137 | 3/1984 | Terauchi | 418/55.5 |
| 4,457,675 | 7/1984 | Inagaki et al. | 418/55.5 |
| 4,484,869 | 11/1984 | Nakayama et al. | 418/55.6 |
| 4,932,845 | 6/1990 | Kikuchi et al. | 417/371 |
| 5,145,346 | 9/1992 | Ho et al. | 418/55.5 |

FOREIGN PATENT DOCUMENTS

| | | | |
|---|---|---|---|
| 2196181 | 8/1990 | Japan | 418/55.5 |

*Primary Examiner*—John J. Vrablik
*Attorney, Agent, or Firm*—Ronald L. Phillips

[57] ABSTRACT

The scroll compressor 10 includes a housing 12, a fixed scroll 18, an orbital scroll 24, an axial thrust and rotation prevention assembly 46, and an orbital scroll drive. The orbital scroll drive includes a crankshaft 74 rotatably journaled in the housing 12. The crankshaft includes an integral disk 76 and an eccentric crank pin 78 with a lubrication passage 96. An eccentric bushing 80 is journaled on the crank pin 78 and in a boss 82 on the orbital scroll by a needle bearing 81. An eccentric bushing retainer 102 has a shank portion 104 that is pressed into the lubrication passage 96 and an enlarged head portion 106 which holds the eccentric bushing 80 on the crank pin 78. If the eccentric bushing retainer 102 becomes partially unseated from the lubrication passage 96, the surface 114 on the enlarged head portion 106 will contact a surface 116 on the end plate 26 of the orbital scroll 24 and keep the eccentric bushing 80 properly positioned within the compressor housing 12. A passage 120 may be provided in the eccentric bushing retainer 102 to control lubrication of the eccentric bushing 80. The eccentric bushing retainer 102 can be made from plastics and other materials which will act as a bearing surface in the event contact is made with the surface 116 on the orbital scroll 24.

5 Claims, 3 Drawing Sheets

SCROLL COMPRESSOR ECCENTRIC BUSHING RETAINER

TECHNICAL FIELD

The invention relates to a scroll type fluid displacement apparatus and more particularly to a scroll compressor. Scroll type compressors are commonly used to compress refrigerant in stationary and mobil air conditioning systems.

BACKGROUND OF THE INVENTION

Scroll type compressors with one orbiting scroll and one fixed or stationary scroll are well known. The Scrolls in these compressors have parallel end plates and involute spiral wrap elements of like pitch. The wrap of one scroll makes line contacts with the wrap of the other scroll and axial edges of the wraps include seals which contact the adjacent scroll end plate to define fluid pockets. As the orbital scroll orbits relative to the fixed scroll, the locations of the contact lines move along the surfaces of the wraps toward the center of the scrolls, the pockets decrease in size compressing the fluid contained in the pockets and the fluid is moved toward the center of the scrolls. A scroll discharge aperture is provided near the center of the fixed scroll to allow compressed fluid to pass from the scrolls into an exhaust or discharge cavity. The exhaust cavity is connected to a fluid discharge opening in the compressor housing.

The compressed fluid in the scroll pockets exerts a force on the scroll end plates which tends to separate the scrolls. An axial thrust assembly is employed to limit axial separation of the scrolls and thereby maintain sealing between the scroll end plates and the axial edges of the wraps. Compressor efficiency drops if fluid moves between the axial edges of the wraps and the end plates, to pockets at a lower pressure. Axial thrust assemblies including a plurality of balls in a space between facing surfaces on the compressor housing and the orbital scroll are in common use to limit axial movement of the orbital scroll and thereby maintain sealing.

An anti-rotation assembly is provided to prevent rotation of the orbital scroll. The assembly may include a first ring with a series of apertures that each surround one of the axial thrust balls and a second ring with apertures that also receive the axial thrust balls. The first ring is fixed to the compressor housing. The second ring is fixed to the orbital scroll. The apertures in the two rings have diameters which will permit orbital movement of the balls and the orbital scroll and prevent rotation of the orbital scroll.

The compressor drive includes a crankshaft rotatably journaled in the compressor housing. An eccentric bushing is journaled on the crankshaft crank pin. The eccentric bushing is also received in a bore in a boss on the forward wall of the orbital scroll end plate. A bearing is provided in the bore in the boss to allow free rotation of the eccentric bushing relative to the orbital scroll.

The eccentric bushing is retained on the crankshaft crank pin by a clip or snap ring. The snap ring limits axial movement of the eccentric bushing on the crankshaft crank pin. Limits on axial movement of the eccentric bushing are required to insure that a balance weight attached to the eccentric bushing does not contact the end plate of the orbital scroll and to insure that the eccentric bushing does not contact the end plate of the orbital scroll.

Snap rings can be difficult to install. Occasionally they are not properly seated in a machined groove in the crankshaft crank pin and fall off after assembly. The loose snap ring may damage the bearing which rotatably receives the eccentric bushing in the bore in the orbital scroll. The eccentric bushing , which is not retained on the crank pin, can move axially along the crank pin until the balance weight contacts the orbital scroll or the eccentric bushing contacts the orbital scroll end plate.

SUMMARY OF THE INVENTION

The primary object of the invention is to retain an eccentric bushing on the crankshaft crank pin of a scroll compressor.

A further object of the invention is to provide an eccentric bushing retainer which will axially retain the eccentric bushing and will not damage the compressor even if it comes loose.

Another object of the invention is to provide an eccentric bushing retainer with an aperture that can control the flow of lubricant to the eccentric bushing.

The scroll compressor employing the eccentric bushing retainer of this invention includes a housing with a front section and a rear section. A fixed scroll with an end plate and an involute wrap is mounted in the rear section of the housing. An orbital scroll with a flat end plate and an involute wrap is positioned within the housing in an angularly and radially offset position relative to the fixed scroll to form at least one pair of fluid pockets. An orbital scroll drive assembly moves the orbital scroll in an orbital path relative to the fixed scroll so that the fluid pockets move toward the center of the scrolls, become smaller and compress fluid in the pockets. A discharge aperture in the center portion of the fixed scroll end plate allows compressed fluid to pass out of the scrolls.

An axial thrust and rotation prevention assembly is mounted in the front section of the housing. The assembly includes a plurality of axial thrust balls which axially position the orbital scroll relative to the fixed scroll to maintain a seal between the axial edge surface of each wrap and the flat end plate of the adjacent scroll. The axial thrust balls, which provide an axial thrust load on the orbital scroll, are each positioned in one of the apertures in a ring attached to the front section of the housing and one of the apertures in a ring attached to the orbital scroll. The apertures in the two rings have the proper diameter relative to the axial thrust balls and the radius of the orbital scroll orbit to permit orbital movement of the orbital scroll and to prevent rotation of the orbital scroll.

The orbital scroll drive assembly includes a crankshaft journaled in the front section of the scroll housing. An eccentric bushing is pivotally attached to the crankshaft crank pin. The eccentric bushing is also rotatably journaled in a boss on the end plate of the orbital scroll. The front side of the orbital scroll end plate, the axial thrust rotation prevention assembly and a portion of the crankshaft are in an area of the housing that is in communication with the fluid inlet.

A passage is drilled through the crankshaft crank pin. This passage provides communication between the inside of the boss on the orbital scroll and areas in the housing that are in communication with the compressor inlet. A function of the passage in the crank pin is to allow lubricant to enter the bore in the boss on the orbital scroll end plate and lubricate the bearing for the eccentric bushing.

An eccentric bushing retainer, including a shank portion and an enlarged head portion, is pressed into the lubrication passage to retain the eccentric bushing on the crank pin. The shank portion of the eccentric bushing retainer includes lands which engage the inside walls of the lubrication passage and hold the eccentric retainer in the lubrication passage. The enlarged head portion of the eccentric bushing retainer is larger in diameter than the diameter of the crank pin so that the eccentric bushing is held on the crank pin by the head portion. The axial thickness of the enlarged head portion of the eccentric bushing retainer is sufficient to contact the surface of the orbital scroll and prevent the eccentric bushing retainer from disengaging from the lubrication passage during operation of the compressor. The head portion of the eccentric bushing retainer also has sufficient axial thickness to prevent the eccentric bushing and the attached balance weight from contacting the orbital scroll when the head portion is in contact with the orbital scroll.

The eccentric bushing retainer is manufactured from a low friction material with resistance to wear. The material is also somewhat resilient. There are plastic materials and metals which would be suitable. A passage may be provided through the center of the eccentric bushing retainer for the passage of lubricant. A passage size can be selected that will control the quantity of lubricant supplied to the eccentric bushing bearing surfaces.

The forgoing and other objects, features and advantages of the present invention will become more apparent in the light of the following detailed description of exemplary embodiments thereof, as illustrated in the accompanying drawing.

DETAILED DESCRIPTION OF THE INVENTION

Figure 1:
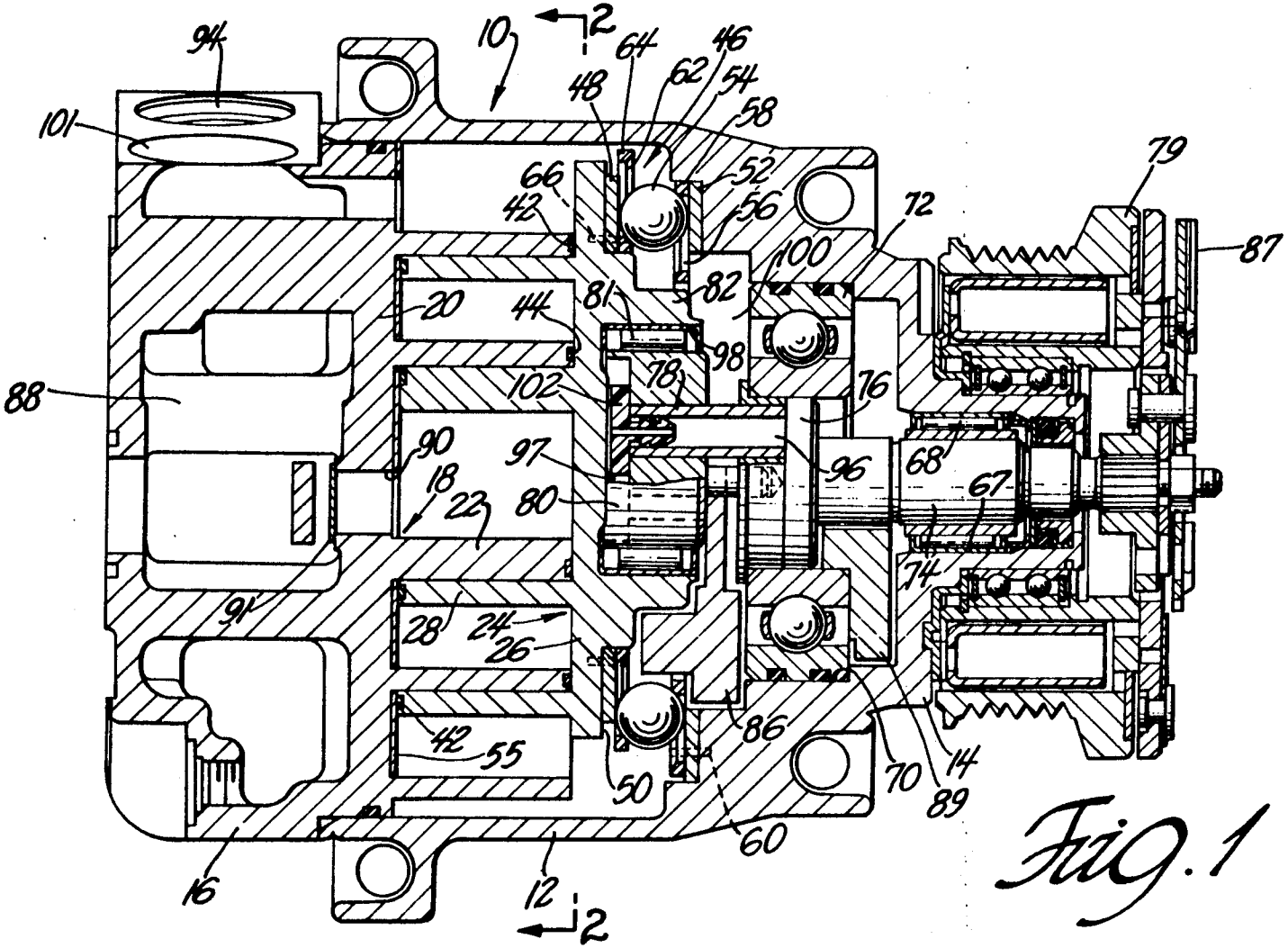
FIG. 1 is a vertical sectional view of a scroll compressor with the eccentric bushing retainer of this invention.

The scroll type compressor 10 as shown in FIG. 1 includes a housing 12 with a front section 14 and a rear section 16. The two sections are held together by bolts that are not shown.

Figure 2:
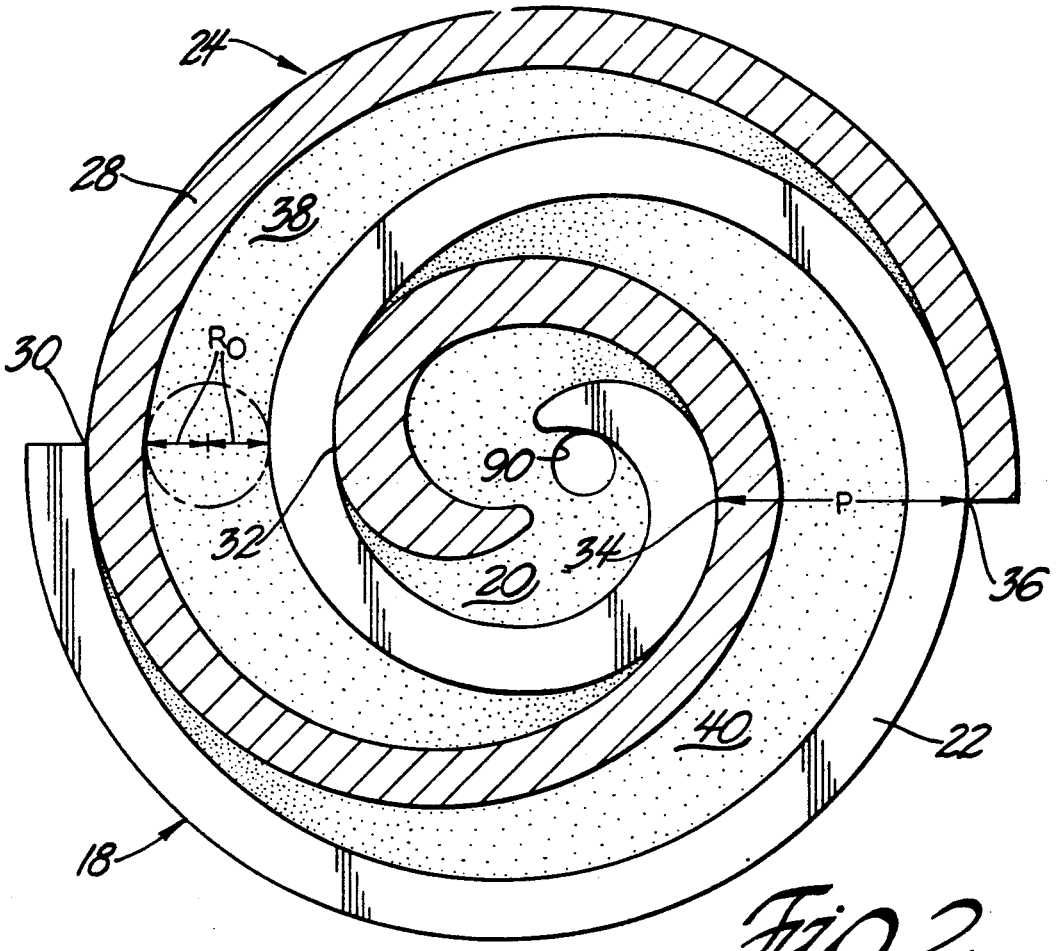
FIG. 2 is an enlarged diagrammatic sectional view of the fixed scroll, and a portion of the orbital scroll taken along lines 2—2 in FIG. 1.

A fixed scroll 18 is an integral part of the rear section 16 of the housing 12. The fixed scroll 18 includes a flat end plate 20 and an involute spiral wrap 22. An orbital scroll 24 is positioned within the housing 12 to cooperate with the fixed scroll 18. The orbital scroll 24 includes a flat end plate 26 and an involute spiral wrap 28. The wrap side surface of the flat end plate 20 is parallel to the wrap side surface of the end plate 26. The wrap 22 of the fixed scroll 18 has the same pitch P as the wrap 28 of orbital scroll 24. The wraps 22 and 28 are in contact with each other along lines perpendicular to the flat end plates 20 and 26. The locations of the contact lines 30, 32, 34 and 36, when the scrolls 18 and 24 are in one position relative to each other, are shown in FIG. 2. The contacts between the wraps 22 and 28 and between the axial ends of the wraps and the flat end plates 20 and 26 form sealed pockets 38 and 40. When the orbital scroll 24 orbits in a counter clockwise direction, as seen in FIG. 2, and in an orbit with a radius Ro, the contact lines 30, 32, 34 and 36 move counter clockwise along the surfaces of the wraps 22 and 28 and the sealed pockets 38 and 40 move toward the center of the scrolls 18 and 24. As the sealed pockets 38 and 40 move toward the center of the scrolls 18 and 24 the pockets become smaller and the fluid in the pockets is compressed.

The involute spiral wraps 22 and 28 have grooves 44 in their axial end surfaces. A seal 42 is retained in each groove. To keep the seals 42 in sealing contact with the flat end plates 20 and 26 of the adjacent scroll, an axial thrust load is applied to the orbital scroll 24 by an axial thrust and rotation prevention assembly 46. The axial thrust and rotation prevention assembly 46 includes a flat ring race 48 secured to a forward surface 50 of the orbital scroll 24, and a flat ring race 52 secured to front section 14 of the housing 12. A number of axial thrust balls 54 are provided between the flat ring races 48 and 52. These axial thrust balls 54 transfer the axial force exerted on the orbital scroll 24 by the compressed fluid in the sealed pockets 38 and 40, from the flat end plate 26 and the flat ring race 48, to the flat ring race 52 and the front section 14 of the housing 12 and maintain the seals 42 in sealing contact with the adjacent scroll flat end plates 20 and 26. At least three axial thrust balls 54 are required. It is common to employ about sixteen axial thrust balls 54 in each axial thrust and rotation prevention assembly 46.

The orbital scroll 24 is an anodized aluminum alloy. The seal 42, in the groove 44, in the involute spiral wrap 22, of the fixed scroll 18; makes direct contact with the anodized surface of the flat end plate 26 of the orbital scroll 24. The fixed scroll 18 is not anodized. A steel anti-wear plate 55, shown in FIG. 1 may be employed as the contact surface of the flat end plate 20. The seal 42 in the groove 44 in the involute spiral wrap 28 of the orbital scroll 24 contacts the surface of the anti-wear plate 55 and slides on the surface during operation of the scroll type compressor 10.

The axial thrust balls 54 are each in an aperture 56 in a ring 58 secured to the front section 14 of the compressor housing 12 by pins 60. The balls 54 are also each in an aperture 62 in a ring 64 secured to the orbital scroll 24 by pins 66. The apertures 56 in the ring 58 and the apertures 62 in ring 64 are the same diameter. The diameter of the apertures 56 and 62 is sufficient to permit orbital movement of the orbital scroll 24 in a path that will maintain contact between the wraps 22 and 28. The axial thrust balls 54 cooperate with the walls of the apertures 56 and 62 in the rings 58 and 64 to prevent rotation of the orbital scroll 24.

Figure 3:
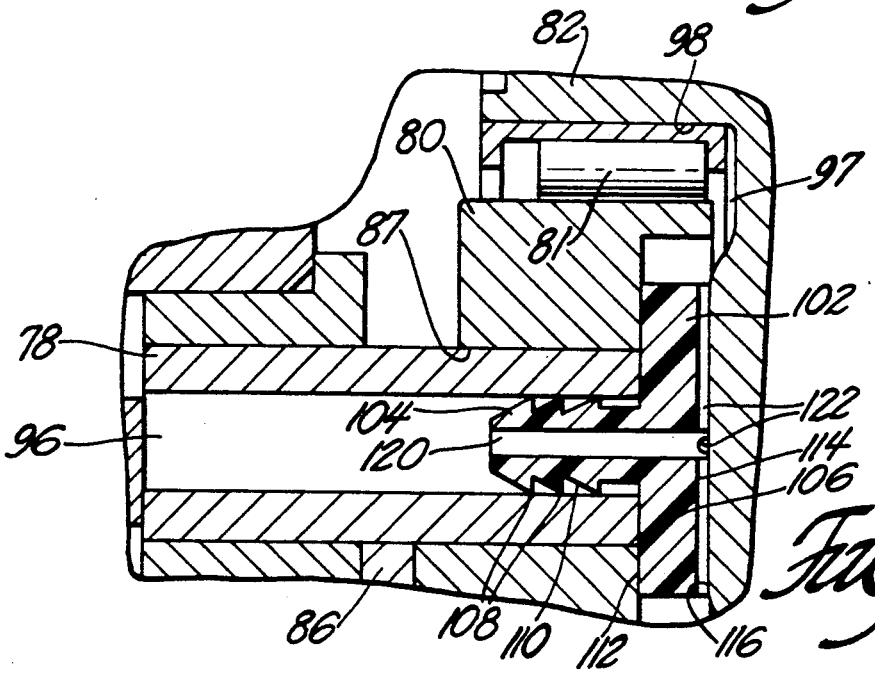
FIG. 3 is an enlarged sectional view of the eccentric bushing retainer, and portions of the eccentric bushing, the crankshaft and the orbital scroll.

The front section 14 of the housing 12 includes a bore 67 for bearing 68 and a bore 70 for bearing 72. The bores 67 and 70 are co-axial. A crankshaft 74 with an integral disk 76 is rotatably journaled in the housing 12 by the bearings 68 and 72. A crank pin 78, as shown in FIGS. 1 and 3, is a pipe member pressed into a bore through the integral disk 76. The crank pin 78 may also be an integral part of the integral disk 76 and have a passage drilled into or through it. An end of crankshaft 74 extends outside the compressor housing 12 and has a belt pulley 79 or other drive means attached.

An eccentric bushing 80 is rotatably journaled by a needle bearing 81 in a boss 82 on the forward surface 50 of the orbital scroll flat end plate 26. The crank pin 78 passes through a bore 87 in the eccentric bushing 80. A balance weight 86 is secured to the eccentric bushing 80. A second balance weight 89 is attached to the integral disk 76. A third balance weight 87 is attached to the end of the crankshaft 74 that extends outside the compressor housing 12.

The rear section 16 of the compressor housing 12 includes an integral exhaust cavity 88. A scroll discharge aperture 90 is provided in the center portion of the flat end plate 20 for the passage of compressed fluid from the scrolls 18 and 24 into the exhaust cavity 88. A reed valve 91 covers the discharge aperture 90 and prevents fluid from flowing from the exhaust cavity 88 and into the scrolls. Compressed fluid passes from the exhaust cavity 88 through a passage which is not shown and exits the housing 12 through an outlet port 94.

The crank pin 78 may include a central lubrication passage 96. This lubrication passage 96 provides communication between the cavity 97, formed by a bore 98 in the boss 82 and closed by the eccentric bushing 80, and the housing crank case 100. The crank case 100 includes the portion of the housing 12 which encloses the axial thrust and rotation prevention assembly 46, the rear portion of the crankshaft 74 and the orbital scroll 24. Fluid and entrained lubricant enter the compressor and the crank case 100 through housing inlet port 101. An eccentric bushing retainer 102 is inserted in the lubrication passage 96 to hold the eccentric bushing 80 on the crank pin 78. The eccentric bushing retainer 102 includes a shank portion 104 and an enlarged head portion 106. The shank portion 104 of the eccentric bushing retainer 102 includes a series of lands 108 and grooves 110. The lands 108 engage the walls of the lubrication passage 96 to hold the eccentric bushing retainer 102 in the position shown in FIG. 3. The lands 108 have a larger diameter than the lubrication passage 96 before they are inserted into the lubrication passage. The resulting interference fit between the lands 108 and the inside wall of the lubrication passage 96 increase the frictional force that tend to hold the eccentric bushing retainer 102 in the lubrication passage 96 in the crank pin 78.

The enlarged head portion 106, of the eccentric bushing retainer 102, includes a flat surface 112 on the forward side which engages the end of the crank pin 78. The flat surface 112 also engages the eccentric bushing 80 and limits axial movement of the eccentric bushing 80 relative to the crank pin 78.

A surface 114 on the rear side of the enlarged head portion 106 is normally spaced from the surface 116 on the flat end plate 26 of the orbital scroll 24. An axial thickness of the enlarged head portion 106 of the eccentric bushing retainer 102 is chosen which provides a small clearance between the surface 116 and the surface 114. The limited clearance between the surface 116 on the end plate 26 and the surface 114 on the eccentric bushing retainer 102 prevents the shank portion 104 from moving out of the lubrication passage 96. The limited clearance also limits axial movement of the flat surface 112 sufficiently to insure that the eccentric bushing 80 and the balance weight 86 can not contact the orbital scroll 24 or the axial thrust and rotation prevention assembly 46.

A passage 120 is provided through the shank portion 104 and the enlarged head portion 106 of the eccentric bushing retainer 102. The passage 120 connects the crank case 100 with the cavity 97 to provide lubrication for the needle bearing 81. The quantity of lubricant passing through the lubrication passage 96 can be controlled by selecting the size of the passage 120.

The eccentric bushing retainer 102 can be made from plastic materials or from some metals. There are several plastic materials and some metals with wear characteristics that would provide an extended life even when the eccentric bushing is in contact with the surface 112 and the surface 114 is in contact with the surface 116 on the orbital scroll 24.

The lubrication passage 96 in the crank pin 78 is not required if an alternate system is provided to lubricate the needle bearing 81. If an alternate lubrication system is provided, the crank pin 78 only requires a bore in its rear end that is sufficiently deep to accommodate the shank portion 104 of the eccentric bushing retainer 102. The passage 120 in the eccentric bushing retainer 102 can be eliminated if it is not required for lubrication.

Figure 4:
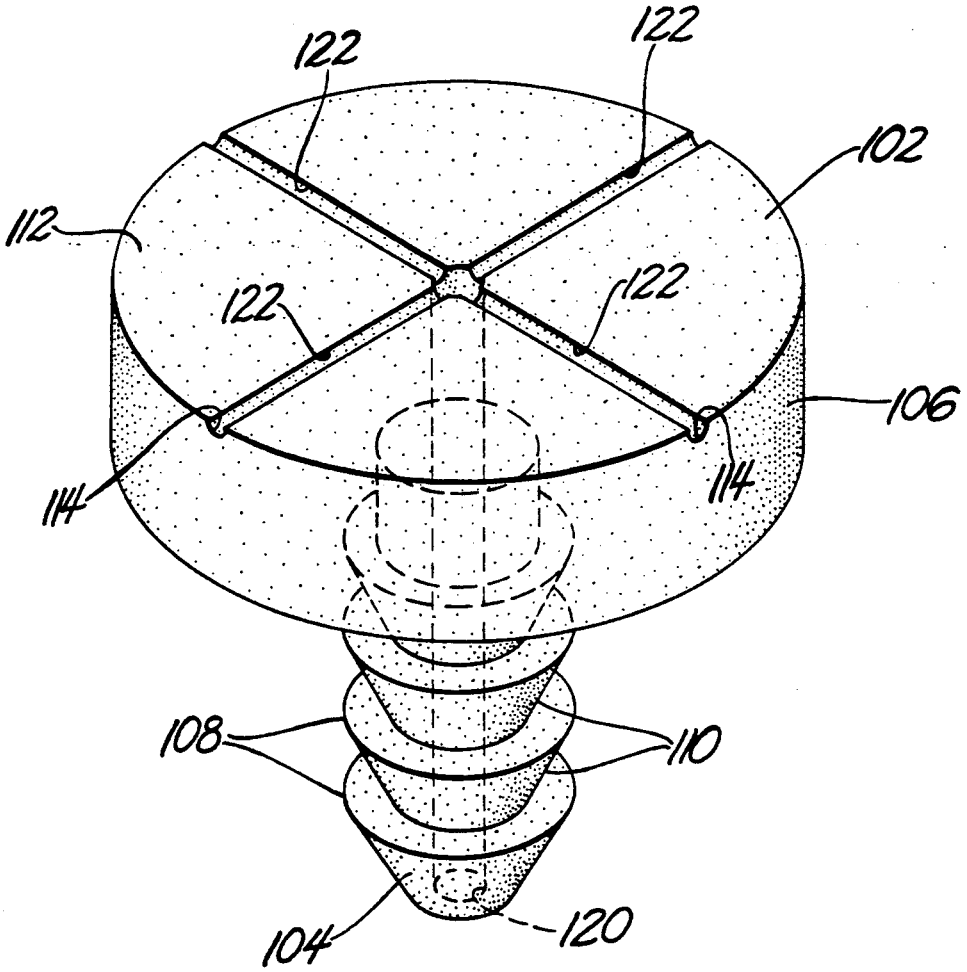
FIG. 4 is an enlarged perspective view of the eccentric bushing retainer with lubrication passages.

Slots 122, shown in FIGS. 3 and 4, are provided in the surface 114 of the enlarged head portion 106 of the eccentric bushing retainer 102 when lubricant must pass through a lubricating passage 96 in the crank pin 78. The slots 122 allow the passage of lubricant when the surface 114 of the enlarged head portion 106 is in contact with the surface 116 on the orbital scroll 24.

The invention has been described in detail in connection with preferred embodiments. It will be understood by those skilled in the art that other variations and modifications can be made which are within the scope of the invention.

We claim:

1. A scroll type compressor having a housing with a front section and a rear section; a fluid inlet in the housing; a fluid outlet in the housing, a fixed scroll with an end plate, a spiral wrap and a central discharge aperture through the end plate, mounted in the rear section of the housing; an orbital scroll with an end plate and a spiral wrap cooperating with the fixed scroll to form fluid pockets; a rotation prevention assembly mounted in the housing which prohibits rotation and allows orbital movement of the orbital scroll; an axial thrust assembly for limiting axial movement of the scrolls; an orbital scroll drive including a crankshaft with an integral disk and an eccentric crank pin rotatably supported in the front section of the housing, a boss on the forward wall of the end plate of the orbital scroll, a bore in the boss, an eccentric bushing journaled in the bore in the boss on the orbital scroll and an aperture in the eccentric bushing which receives the crankshaft crank pin; a cavity in the front section of the housing forming a crankcase that is in communication with the fluid inlet port; a lubrication passage through the crank pin which allows fluid and entrained lubricant to pass from the crankcase to the bore on the orbital scroll in which the eccentric bushing is journaled; an eccentric bushing retainer including a shank portion and an enlarged head portion with the shank portion pressed into the lubrication passage, the enlarged head portion limiting axial movement of the eccentric bushing on the crank pin and a passage through the shank portion and the enlarged head portion for metering the flow of lubricant through the crank pin.

2. A scroll type compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and spiral wrap cooperating with the fixed scroll to form fluid pockets; a rotation prevention assembly mounted in the housing which prohibits rotation and allows orbital movement of the orbital scroll; an orbital scroll drive including a crankshaft with an integral eccentric crank pin rotatably supported in the front section of the housing; a boss on the forward wall of the end plate of the orbital scroll, a bore in the boss, an eccentric bushing journaled in the bore in the boss on the orbital scroll and an aperture in the eccentric bushing which receives the crankshaft crank pin; a passage through at least a portion of the crank pin; and an eccentric bushing retainer including a shank portion and an enlarged head portion with the shank portion pressed into the passage through at least a portion of the crank pin and with the enlarged head portion limiting axial movement of the eccentric bushing on the crank pin.

3. A scroll type compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and spiral wrap cooperating with the fixed scroll to form fluid pockets; a rotation prevention assembly mounted in the housing which prohibits rotation and allows orbital movement of the orbital scroll; an orbital scroll drive including a crankshaft with an integral eccentric crank pin rotatably supported in the front section of the housing; a boss on the forward wall of the end plate of the orbital scroll, a bore in the boss, an eccentric bushing journaled in the bore in the boss on the orbital scroll and an aperture in the eccentric bushing which receives the crankshaft crank pin; a passage through at least a portion of the crank pin; and an eccentric bushing retainer including a shank portion and an enlarged head portion with the shank portion pressed into the passage through at least a portion of the crank pin, with the enlarged head portion limiting axial movement of the eccentric bushing on the crank pin and wherein the enlarged head portion is confined between the crank pin and the orbital scroll and is operable to prevent the shank portion from becoming disengaged from the passage in the crank pin.

4. A scroll type compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and spiral wrap cooperating with the fixed scroll to form fluid pockets; a rotation prevention assembly mounted in the housing which prohibits rotation and allows orbital movement of the Orbital scroll; an orbital scroll drive including a crankshaft with an eccentric crank pin rotatably supported in the front section of the housing; a boss on the forward wall of the end plate of the orbital scroll, a bore in the boss, an eccentric bushing journaled in the bore in the boss on the orbital scroll and an aperture in the eccentric bushing which receives the crankshaft crank pin; a passage through at least a portion of the crank pin; and an eccentric bushing retainer including a shank portion and an enlarged head portion with the shank portion pressed into the passage through at least a portion of the crank pin, with the enlarged head portion limiting axial movement of the eccentric bushing on the crank pin and wherein the eccentric bushing retainer is a plastic material.

5. A scroll type compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and spiral wrap cooperating with the fixed scroll to form fluid pockets; a rotation prevention assembly mounted in the housing which prohibits rotation and allows orbital movement of the orbital scroll; an orbital scroll drive including a crankshaft with an integral eccentric crank pin rotatably supported in the front section of the housing; a boss on the forward wall of the end plate of the orbital scroll, a bore in the boss, an eccentric bushing journaled in the bore in the boss on the orbital scroll and an aperture in the eccentric bushing which receives the crankshaft crank pin; a passage through at least a portion of the crank pin; and an eccentric bushing retainer including a shank portion and an enlarged head portion with the shank portion pressed into the passage through at least a portion of the crank pin, with the enlarged head portion limiting axial movement of the eccentric bushing on the crank pin and wherein the enlarged head portion is confined between the crank pin and the orbital scroll and is operable to prevent the shank portion from becoming disengaged from the passage in the crank pin and wherein the eccentric bushing retainer is a plastic material.

* * * * *